US008132807B2

(12) United States Patent
Androsyuk et al.

(10) Patent No.: US 8,132,807 B2
(45) Date of Patent: Mar. 13, 2012

(54) VALIDATOR DRIVE ROLLER RELEASE MECHANISM

(75) Inventors: Sergiy Androsyuk, Concord (CA); Oleksandr Panchenko, Concord (CA)

(73) Assignee: Crane Canada Co., Concord, ON (CA)

( * ) Notice: Subject to any disclaimer, the term of this patent is extended or adjusted under 35 U.S.C. 154(b) by 0 days.

(21) Appl. No.: 12/923,955

(22) Filed: Oct. 18, 2010

(65) Prior Publication Data

US 2011/0089630 A1 Apr. 21, 2011

(30) Foreign Application Priority Data

Oct. 16, 2009 (CA) ..... 2683176

(51) Int. Cl.
*B65H 3/06* (2006.01)

(52) U.S. Cl. ..... 271/116; 271/10.13; 194/206

(58) Field of Classification Search ..... 271/116, 271/264, 3.01, 10.13, 266; 194/203, 206, 194/207

See application file for complete search history.

(56) References Cited

U.S. PATENT DOCUMENTS

| | | | | |
|---|---|---|---|---|
| 5,316,117 | A | 5/1994 | Griner et al. | |
| 5,358,230 | A | 10/1994 | Ikemori et al. | |
| 5,873,441 | A * | 2/1999 | Tsujishita | 192/46 |
| 6,390,467 | B1 * | 5/2002 | Fukube | 271/256 |
| 6,464,217 | B1 * | 10/2002 | Kulpa et al. | 271/116 |
| 6,578,840 | B1 * | 6/2003 | Kudo | 271/10.13 |
| 6,959,859 | B2 * | 11/2005 | Saltsov et al. | 235/379 |
| 6,991,083 | B2 | 1/2006 | Yoshioka et al. | |
| 2008/0023903 | A1 * | 1/2008 | Liu et al. | 271/10.13 |
| 2010/0270120 | A1 * | 10/2010 | Nireki | 194/206 |

* cited by examiner

*Primary Examiner* — Kaitlin Joerger

(57) ABSTRACT

The drive arrangement of a currency validator includes a drive roller release mechanism that provides release of the rollers from a drive shaft. This release allows a banknote to be forcibly withdrawn without damaging a drive train or the drive roller. The drive roller is supported on and rotatable about a drive shaft. The drive shaft includes an intermediary drive ring secured on the shaft and in engagement with the drive roller. A spring bias urges the drive roller to engage and rotate with rotation of the shaft and the intermediary drive ring secured on the shaft. When necessary the drive roller can rotate relative to the shaft by overcoming the spring bias.

5 Claims, 3 Drawing Sheets

VALIDATOR DRIVE ROLLER RELEASE MECHANISM

FIELD OF THE INVENTION

The present invention relates to currency validators, and in particular, to drive rollers of currency validators that are prone to damage when a banknote is improperly withdrawn from such a validator.

BACKGROUND OF THE INVENTION

Banknote or currency validators are now commonly used as part of an automated payment system associated with a host of vending machines and payment solutions. These payment systems are often installed in untended locations and are not supervised. There are a number of well known fraudulent schemes that are attempted in such unsupervised locations to defeat the payment system. One of the more common strategies is referred to as "phishing" where a string or plastic tail is attached to the rear edge of a banknote for forced withdrawal of the banknote from the currency validator after it has been approved for payment. Most currency validators can detect the actual string or tail during receipt of a banknote or can detect reverse movement of a banknote from a validator. Therefore, this attempt to defeat the currency validator or effect unauthorized payment using this technique is not successful. However, the actual currency validator can be damaged by the forced withdrawal of a banknote from the validator. Certain drive rollers associated with the banknote processing path are more vulnerable to damage and the present invention provides an effective solution for releasing such vulnerable drive rollers such that damage does not occur.

SUMMARY OF THE INVENTION

In the present invention a banknote validator has an improved drive train for drive rollers. The banknote validator has a banknote drive path and a series of banknote drive rollers for advancing a banknote along the drive path past a series of sensors used to determine the authenticity of the banknote. The drive train is operatively coupled to the drive rollers for coordinated rotation thereof. The improvement comprises at least one of the drive rollers being connected to a drive shaft through an intermediary drive ring secured on and rotatable with the drive shaft. The at least one drive roller is freely rotatable on the drive shaft when disengaged from the intermediary drive ring. The at least one drive roller and the intermediary drive ring include mating drive surfaces on opposed faces. A spring bias is provided for urging the drive surfaces into engagement for driving of the at least one drive roller with rotation of the drive shaft and automatically disengaging the mating drive surfaces when a banknote is improperly withdrawn.

According to an aspect of the invention, the drive surfaces include radially disposed grooves and ridges that cam over each other during improper withdrawal of a banknote.

In a further aspect of the invention, the intermediary drive ring and the at least one drive roller during improper withdrawal of a banknote, release and allow relative rotation therebetween. This relative rotation produces an audible noise that acts as a deterrent to improper withdrawal of a banknote.

In a further aspect of the invention, the at least one drive roller is two drive rollers supported on the same drive shaft and each drive roller has an associated intermediary drive ring.

In yet a further aspect of the invention a single spring bias is located between drive rollers and forces each drive roller towards opposite ends of the drive shaft into engagement with the intermediary drive rings secured on the drive shaft and positioned to capture the drive rollers on the drive shaft.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
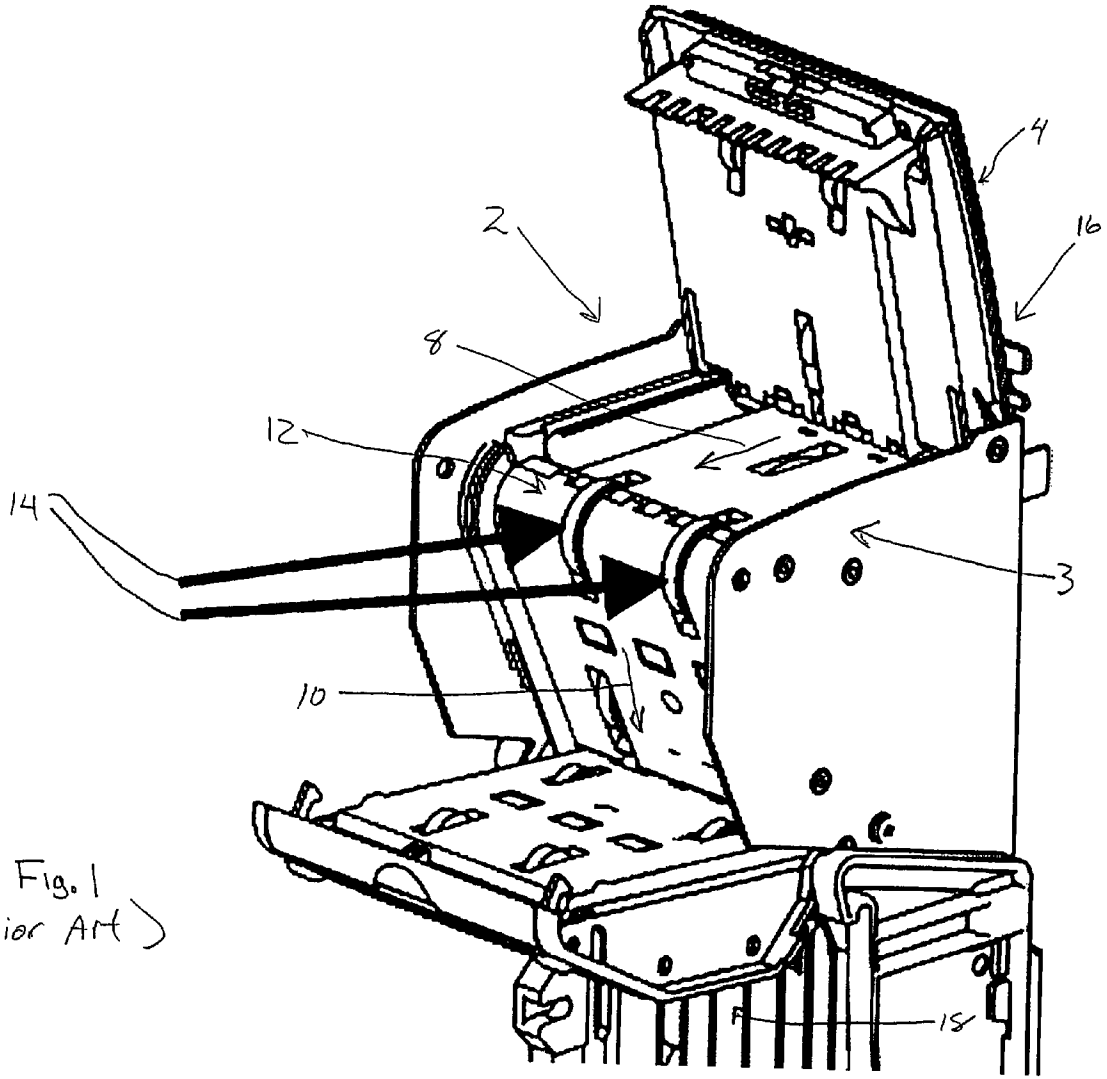
Fig. 1 (Prior Art)
FIG. 1 is a partial perspective view of a currency validator showing details of the banknote drive path.

The currency validator 2 shown in FIG. 1 includes a body portion 3 with a hinged top access panel 4 and a hinged rear access panel 6. A banknote drive path generally indicated as 8 and 10 is located between the body portion 3 and the hinged top access panel 4 and the hinged rear access panel 6. Access panels 4 and 6 in FIG. 1 are shown in an open position to allow access to the banknote drive path for servicing of the validator. The banknote drive path indicated as 8 and 10 are joined by a curved transition generally shown as 12. This curved transition includes drive rollers 14 and it has been found that these particular drive rollers are vulnerable to damage if a banknote is improperly withdrawn from the banknote path.

The currency validator 2 includes a banknote entry position generally shown as 16, and this banknote entry position includes a slot through which banknotes are fed. The banknote, after passing through the currency validator 2, is discharged at position 18 and banknotes may be stored in a banknote cassette or merely loosely accumulated in a banknote storage box. Other arrangements for storing banknotes such as banknote accumulators can also be associated with the discharge position 18.

"Phishing" is one of the more common approaches used in attempts to defeat currency validators. A string or tail is attached to the trailing edge of a banknote and this tail or string is used to force withdrawal of the banknote from the currency validator after it has been validated. The various sensors located along a banknote drive path and the operation of the currency validator can detect this type of fraudulent activity, however even though the currency validator is not defeated, the forced withdrawal of a banknote from the currency validator can damage the drive rollers 14. These drive rollers are preferably made as an injection molded plastic component and are secured or keyed to a drive shaft. These rollers can break or lose drive engagement with the associated drive shaft if a banknote is forcibly withdrawn. If the rollers break or are stripped the payment system requires significant service that typically is not immediately available.

As described in the Background of the Invention, many currency validators are in unsupervised locations and this damage by improper withdrawal of a banknote effectively places the currency validator out of service. Furthermore, when a service person arrives to service the validator it is not a simple matter to replace the drive rollers. As a result the validator is often replaced to allow more time for service.

To overcome the above problems, a different arrangement for these drive rollers is shown in FIGS. 2 through 5. The drive rollers 54 in these figures replace drive rollers 14 shown in FIG. 1.

Figure 2:
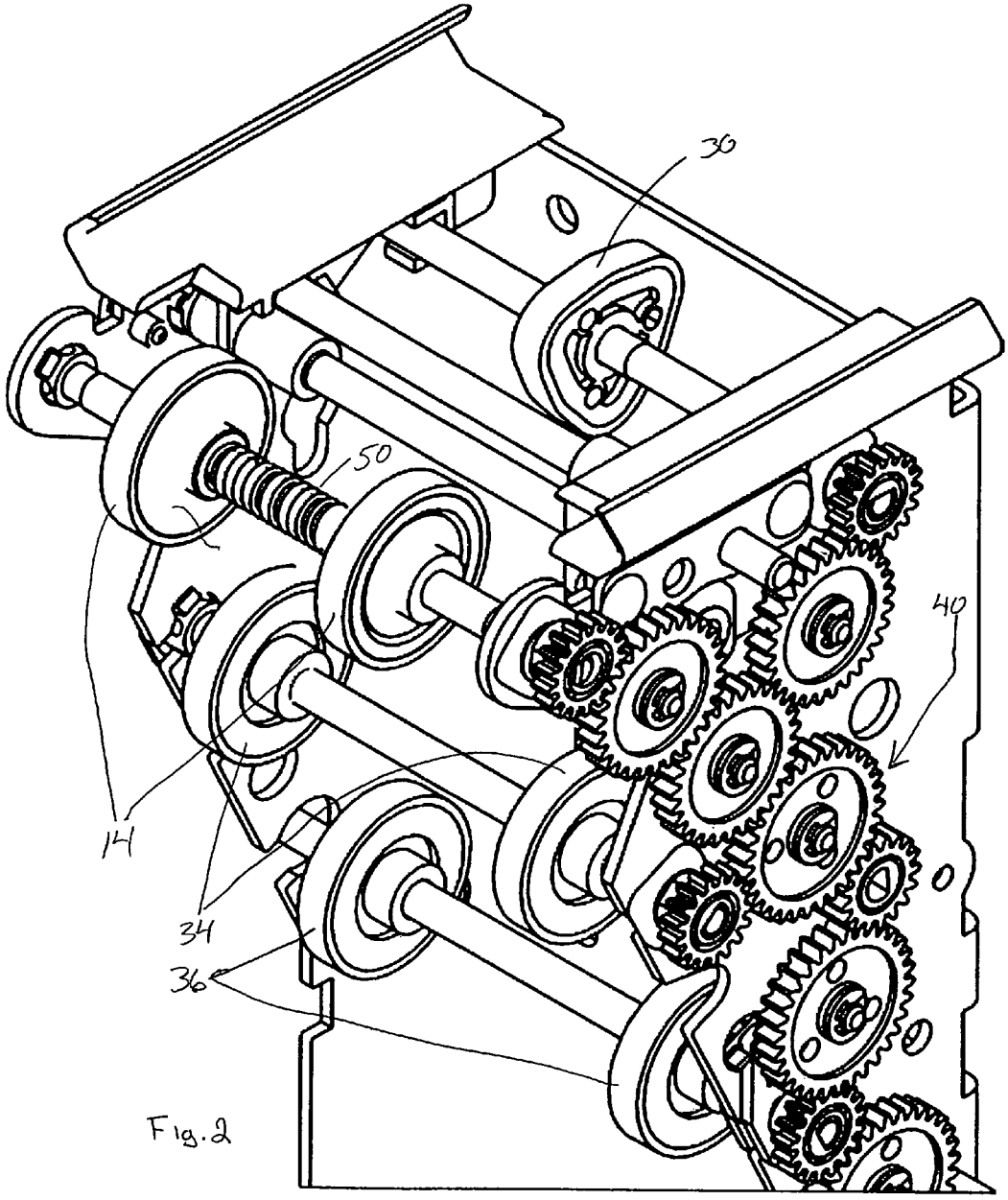
FIG. 2 is a partial perspective view showing the drive train and drive rollers of the currency validator of FIG. 1 and the automatic release mechanism.
Figure 3:
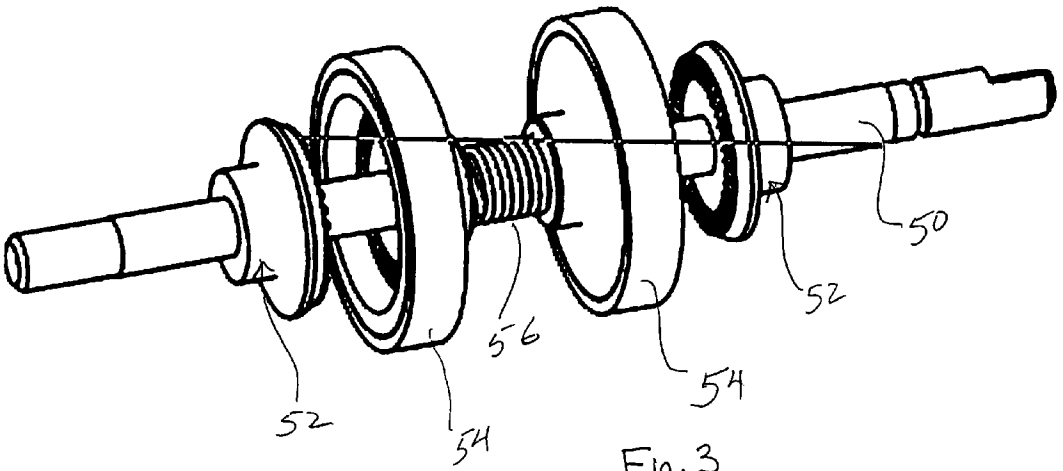
FIG. 3 is a perspective view of the automatic release rollers mounted on a drive shaft.
Figure 5:
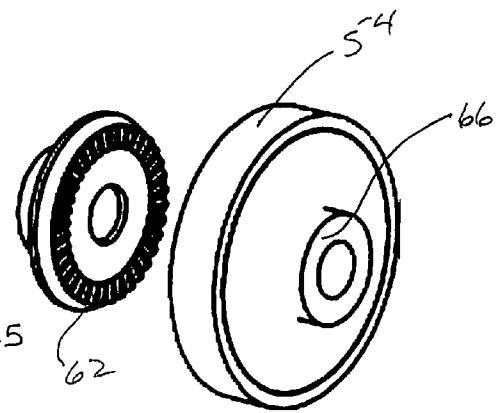
FIG. 4 shows details of a left drive roller arrangement and FIG. 5 shows details of a right drive roller arrangement.
Figure 4:
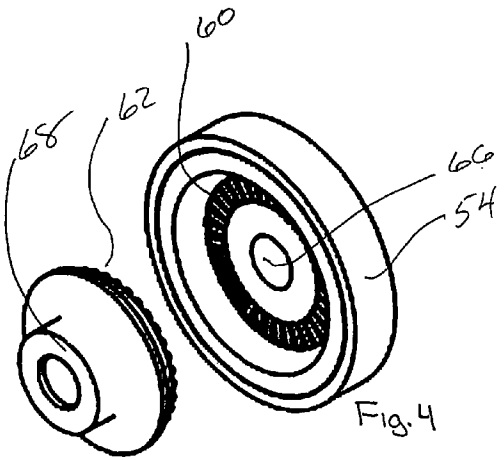

The drive rollers 54, as shown in FIG. 3 are slidably mounted on the drive shaft 50 which is driven by a gear of the drive train 40 shown in FIG. 2. The drive rollers 54 are rotatable on the drive shaft 50 and a spring 56 urges the drive rollers 54 against the associated intermediary drive rings 52. Drive rings 52 are secured to the shaft 50 and rotate with rotation of the drive shaft 50. Details of the intermediary drive rings 52 are shown in FIGS. 4 and 5. Each intermediary drive ring 52 includes drive projections 62 on drive face 63 which is in opposed relationship with the associated drive roller 54. Drive roller 54 includes drive grooves 60 on an inner drive surface thereof that mate with the drive projections 62. The spring 56 urges each of the drive rollers 54 into drive engagement with the drive grooves 60 of the associated intermediary drive rings 52. During normal operation of the currency validator, drive shaft 50 is rotated by the drive train to appropriately move a banknote along the banknote drive path and the drive rings 52 and the drive rollers 54 are in engagement such that the rollers 54 contact the banknote and appropriately move the banknote in either direction along the banknote path.

If a banknote that is being processed is improperly withdrawn by a user using a string or tail attached to the trailing edge of the banknote, the drive rollers 54 will be forced to move along the shaft towards one another, whereby the drive rollers can rotate on the shaft 50. Basically, the drive grooves and the drive projections cam across one another to allow the rollers to be disengaged from the shaft. The drive rollers can thereby rotate relative to the shaft as the banknote is withdrawn.

With this arrangement the drive rings 52 and the drive rollers 54 can be made of an injection molded plastic, and improper withdrawal of a banknote does not cause damage to these rollers. In addition, the drive grooves and drive projections, as they are forced to pass over one another during the improper removal of a banknote, create a ratcheting type noise which acts as a further deterrent of this fraudulent activity. This may be helpful in some situations where there is limited supervision of the payment system or other customers may be present. The drive grooves and projections are adjacent to each other and a repetitive disengage, engage cycle of these surfaces creates the audio deterrent signal during fraudulent withdrawal, of a banknote. The drive grooves and ridges are separated from and spaced outwardly of the drive shaft as shown in FIGS. 4 and 5.

As previously indicated, this attempt to withdraw a banknote is easily detected by the payment system, however this activity previously damaged the banknote drive whereby service of the validator was necessary. The present arrangement provides a simple cost effective solution that allows these drive rollers to continue to be made in a cost effective way i.e. the rollers and their drive rings can be injection molded plastic components, and a simple ratchet-type clutch arrangement is provided. This solution has overcome the service problems and also acts as an audible deterrent to this fraudulent activity.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In a banknote validator having a banknote drive path and a series of banknote drive rollers for advancing a banknote along said drive path past a series of sensors used to determine the authenticity of the banknote, and a drive train operatively coupled to said drive rollers for coordinated rotation thereof the improvement comprising at least one of said drive rollers being connected to a drive shaft through an intermediary drive ring secured on and rotatable with said drive shaft, said at least one drive roller being freely rotatable on said drive shaft when disengaged from said intermediary drive ring, said at least one drive roller and said intermediary drive ring each including a series of mating adjacent drive surfaces on opposed faces positioned outwardly of and separated from said drive shaft;

said at least one drive roller and said intermediary drive ring include a spring bias for urging said drive surfaces into engagement for driving of said at least one drive roller with rotation of said drive shaft and automatically repetitively disengage and engage said mating drive surfaces when a banknote is improperly withdrawn to create an audio deterrent signal.

2. In a banknote validator as claimed in claim 1 wherein said drive surfaces include radially disposed alternating grooves and ridges that cam over each other during withdrawal of a banknote.

3. In a banknote validator as claimed in claim 1 wherein said at least one drive roller is two drive rollers supported on the same drive shaft and each drive roller has an associated intermediary drive ring.

4. In a banknote validator as claimed in claim 3 wherein a single spring bias is located between drive rollers and forces each drive roller towards opposite ends of said drive shaft into engagement with said intermediary drive rings secured on said drive shaft and positioned to capture said driverollers on said drive shaft.

5. In a banknote validator as claimed in claim 1 wherein each drive roller and each drive ring is an injection molded plastic component with said drive surfaces integral therewith.

* * * * *